US007299722B2

(12) United States Patent
Lu

(10) Patent No.: US 7,299,722 B2
(45) Date of Patent: Nov. 27, 2007

(54) ADJUSTABLE WRENCH FOR ADJUSTING THE WIDTH OF THE JAW QUICKLY

(76) Inventor: Hong Lu, Room 11E, Building E, Huatingjiayuan, No. 6 Beisihuanzhonglu, Chaoyang District, Beijing (CN) 100029

( * ) Notice: Subject to any disclaimer, the term of this patent is extended or adjusted under 35 U.S.C. 154(b) by 120 days.

(21) Appl. No.: 10/543,032

(22) PCT Filed: Sep. 28, 2003

(86) PCT No.: PCT/CN03/00829

§ 371 (c)(1),
(2), (4) Date: Jul. 21, 2005

(87) PCT Pub. No.: WO2004/065066

PCT Pub. Date: Aug. 5, 2004

(65) Prior Publication Data

US 2006/0130619 A1 Jun. 22, 2006

(30) Foreign Application Priority Data

Jan. 23, 2003 (CN) ..... 03 2 14884

(51) Int. Cl.
*B25B 13/16* (2006.01)

(52) U.S. Cl. ..... 81/165; 81/170

(58) Field of Classification Search ..... 81/165–170, 81/129, 129.5, 155
See application file for complete search history.

(56) References Cited

U.S. PATENT DOCUMENTS 2,983,173 A 5/1961 Buxton, Jr.
3,901,107 A * 8/1975 Halls ..... 81/170
4,437,364 A 3/1984 Martinmaas
4,706,528 A 11/1987 Inoue ..... 81/179
4,813,309 A 3/1989 Kang ..... 81/57.43
2003/0183048 A1 10/2003 Olsen
2004/0031359 A1 2/2004 Kady

FOREIGN PATENT DOCUMENTS

CN 86204867 U 4/1987

(Continued)

*Primary Examiner*—D. S. Meislin
(74) *Attorney, Agent, or Firm*—Seed IP Law Group PLLC

(57) ABSTRACT

An adjustable wrench for quickly adjusting the width of a jaw thereof, comprising a stationary body (1), having a chamber (12) at an upper portion thereof; a movable body (2), having a worm (13) at a lower portion thereof, being movable transversely inside the chamber (12); a driving mechanism (100) located within the chamber (12), including a worm gear (10) with a worm gear shaft (20), engaging the worm (13), a first gear (3) mounted at an end of the worm gear shaft (20) of the worm gear (10), a connection shaft (9) located under the worm gear shaft (20) in parallel, and a second gear (4) mounted at an end of the connection shaft (9) to engage with the first gear (3); and a traction mechanism (200) connected to the connection shaft (9), the traction mechanism (200) driving the second gear (4) to rotate by driving the connection shaft (9), which drives the first gear (3) to rotate, hereby rendering the worm (13) to move inside the chamber (12). The adjustable wrench in accordance with the present invention can be adjusted rapidly in the width of the jaw, and is easy to operation with a single hand.

8 Claims, 4 Drawing Sheets

FOREIGN PATENT DOCUMENTS

| | | | | |
|---|---|---|---|---|
| CN | 2069335 | U | | 1/1991 |
| CN | 2139873 | Y | | 8/1993 |
| CN | 1025300 | C | | 7/1994 |
| CN | 2243367 | Y | | 12/1996 |
| CN | 1227780 | | * | 9/1999 |

* cited by examiner

ADJUSTABLE WRENCH FOR ADJUSTING THE WIDTH OF THE JAW QUICKLY

CROSS-REFERENCE TO RELATED APPLICATIONS

This application is a U.S. National Stage of PCT/CN2003/000829 filed Sep. 28, 2003, which claims priority to Chinese Application No. 03214884.4 filed Jan. 23, 2003, which applications are incorporated herein by reference in their entireties.

BACKGROUND OF THE INVENTION

1. Field of the Invention

The present invention relates to an adjustable wrench for quickly adjusting width of the jaw thereof. The width of the jaw of the wrench can be quickly adjusted to a desired size by simply moving a movable body of the wrench.

2. Description of the Prior Art

A conventional adjustable wrench comprises a movable body and a stationary body. A worm mechanism is provided at a lower portion of the movable body. A square hole is disposed in the stationary body to receive a section of the worm mechanism of the movable body. A worm gear is provided within the square hole to engage a worm of the movable body. When a user manually rotates the worm gear, the worm can move in a left-and-right direction corresponding to the rotation of the worm gear, which in turn drives the movable body to move in the same direction, thereby adjusting the width of a jaw of the wrench.

The adjustable wrench having the aforesaid configuration is relatively simple in construction and convenient for use. However, such a wrench has disadvantages that when the width required to be adjusted is relatively large, the worm gear must be turned frequently. For example, if a large size wrench is used in exploitation of oil where a relatively larger pipe or nut needs to be turned, it is necessary to turn the worm repeatedly to give a full jaw travel. Furthermore, it is difficult to reliably hold an object by manually adjusting the width of the jaw.

In order to solve these problems, Chinese Patent No. CN2196532 with a title of "a quickly adjustable double ended wrench", issued on May 10, 1995, discloses an adjustable wrench of which the width of the jaw can be quickly adjusted. During the adjustment of the width of the jaw, the worm and the worm gear are first separated by one hand, then the movable body is adjusted to a desired position by the other hand, and finally the worm and the worm gear should be arranged to engage with each other. This kind of wrench overcomes to some extent the abovementioned defects of the adjustable wrench. However, the wrench must be operated with both hands, which could be further improved.

Moreover, an adjustable open end wrench is also disclosed in U.S. Pat. No. 3,555,939. A slot is provided along one side of a handle of a stationary body of the adjustable wrench to communicate with a cavity for receiving a worm gear. A helical shaft is provided in the slot. A bevel gear is provided at an end of the helical shaft close to the cavity to intermeshes with another bevel gear disposed at an end of the worm. A thumb button control is provided at the handle, an end of which is slidable along a groove of the worm. In this way, while the thumb button control is pushed, the worm will rotate to in turn drive the movable body to move. This type of wrench can be adjusted by one hand. However, this adjustable open end wrench is relatively complex to construct and incurs a high cost.

BRIEF SUMMARY OF THE INVENTION

To overcome the shortcomings in the prior art as described above, the present invention provides an adjustable wrench which can rapidly be adjusted to any desired position with a simple operation by one hand, and can be manufactured with a sample process and a low cost.

To accomplish the foregoing object, the present invention provides an adjustable wrench for adjusting the width of a jaw quickly. The wrench of the invention comprises a stationary body having a chamber disposed at an upper portion thereof; a movable body having a worm disposed at a lower portion thereof, the worm being transversely movable inside the chamber; a driving mechanism located within the chamber, including a worm gear engaging the worm, a worm gear shaft, a first gear locatedcoaxially at an end of the worm gear shaft of the worm gear, a connection shaft located under and parallel to the worm gear shaft, a second gear mounted at an end of the connection shaft engaging the first gear; and a traction mechanism connected to the connection shaft, the traction mechanism driving the connection shaft to rotate so that the second gear drives the first gear to rotate, thereby rendering the worm to move within the chamber.

The driving mechanism of the adjustable wrench of the present invention may further include two joint flakes with which the worm gear and the driving mechanism can be integrated. Two circular holes are provided respectively at each joint flake to receive the two ends of the worm gear shaft and those of the connection shaft. The worm gear shaft and the connection shaft are rotatable within the circular holes.

According to a preferred embodiment of the present invention, the stationary body further includes an elongated cavity disposed at a side of a handle of the stationary body, and the traction mechanism includes a guiding wheel placed within the elongated cavity at an end thereof away from the chamber, and a driving rope wrapped around the guiding wheel and connected to the connection shaft. Preferably, the driving rope is made of high strength and durable materials, and is of a little bit elasticity. A control button is secured at a section of the driving rope.

In a preferred embodiment, the driving rope is tightly wound in a direction around the connection shaft close to the second worm gear, and is then tightly wound in an opposite direction around the connection shaft after wrapped around the guiding wheel.

The adjustable wrench of the present invention may further include a cover plate having a shape corresponding to a peripheral shape of the chamber and the elongated cavity. An elongated opening is formed at the cover plate so that the control button is shown up therethrough. The cover plate is secured at the stationary body by means of a joint member for covering the chamber and the elongated cavity.

Moreover, according to the adjustable wrench of the present invention, a square through hole may be provided at the handle of the stationary body to allow insertion of a handle of a socket wrench.

In the present invention, the movement of the movable body is realized by pulling the driving rope to quickly rotate the worm instead of by manually turning the worm in the prior art. Thus, the adjustment of the moveable body can be accomplished in a more speedy and convenient manner just by one hand. When an object is turned, the movable body is self-locked through the cooperation of the worm and the worm gear, which makes the wrench reliable in operation. Moreover, the present invention employs spur gears rather than bevel gears in the prior art such that the wrench is relatively simple in construction, and also uses the driving rope to realize the driving mechanism, which can further lower the cost.

BRIEF DESCRIPTION OF THE DRAWINGS

With reference to the drawings, the embodiments of the present invention will be further described as follows.

DETAILED DESCRIPTION OF THE INVENTION

Figure 1:
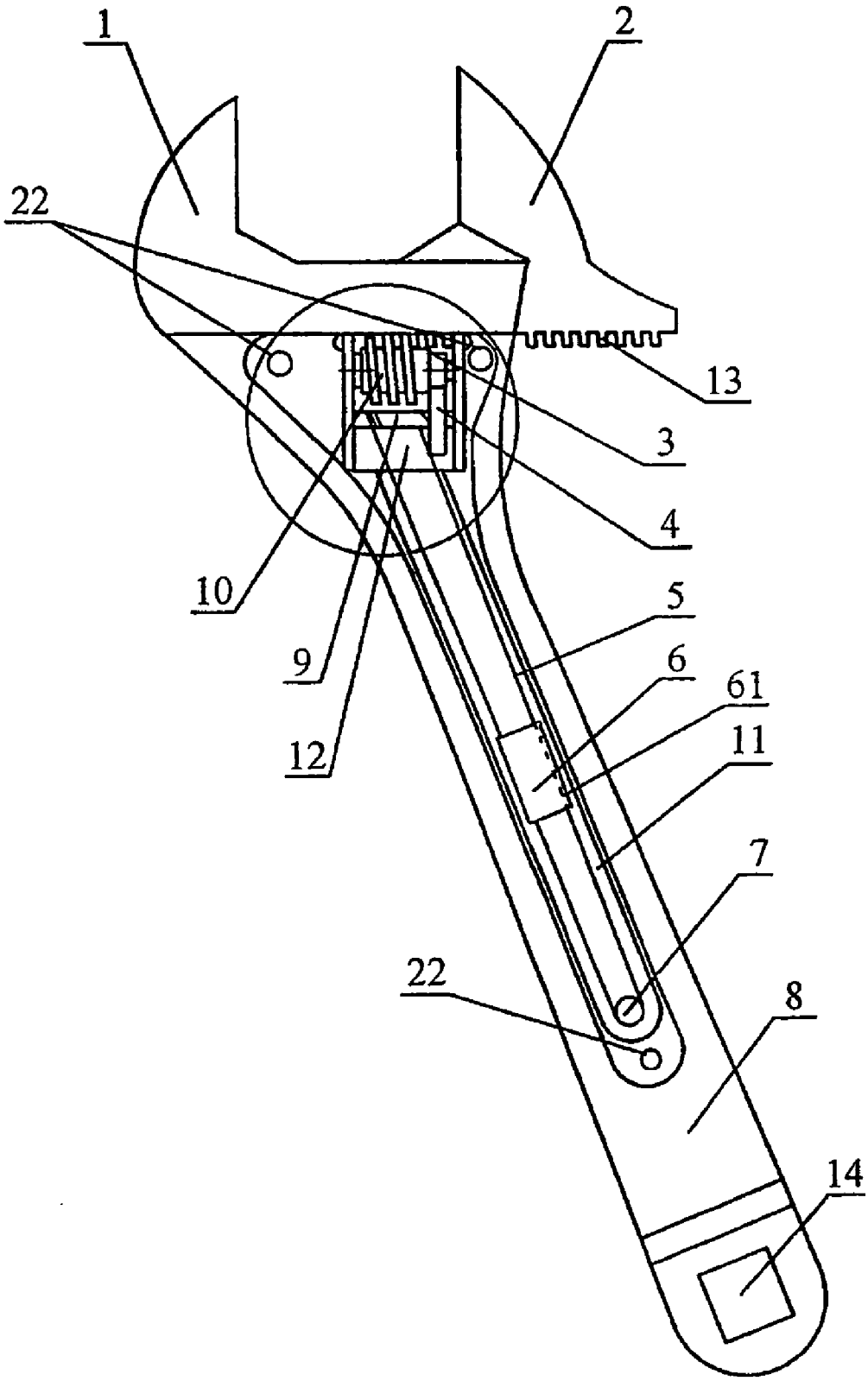
FIG. 1 is a schematic view showing the structure of an adjustable wrench according to one embodiment of the present invention.

As shown in FIG. 1, an adjustable wrench of an embodiment of the present invention includes a stationary body 1 and a movable body 2. A worm 13 is disposed at a lower portion of the movable body 2. A chamber 12 is provided at an upper portion of the stationary body 1, which is of a square shape but apparently may be of other suitable shapes. The worm 13 with a section thereof can transversely move within the chamber 12 to engage a worm gear 10 disposed within the chamber 12. By rotating the worm gear 10, the worm 13 can move in a left-and-right direction with respect to the stationary body, thereby causing the movable body to move in the same direction. These elements of the adjustable wrench are the same as those in the prior art.

Figure 2:
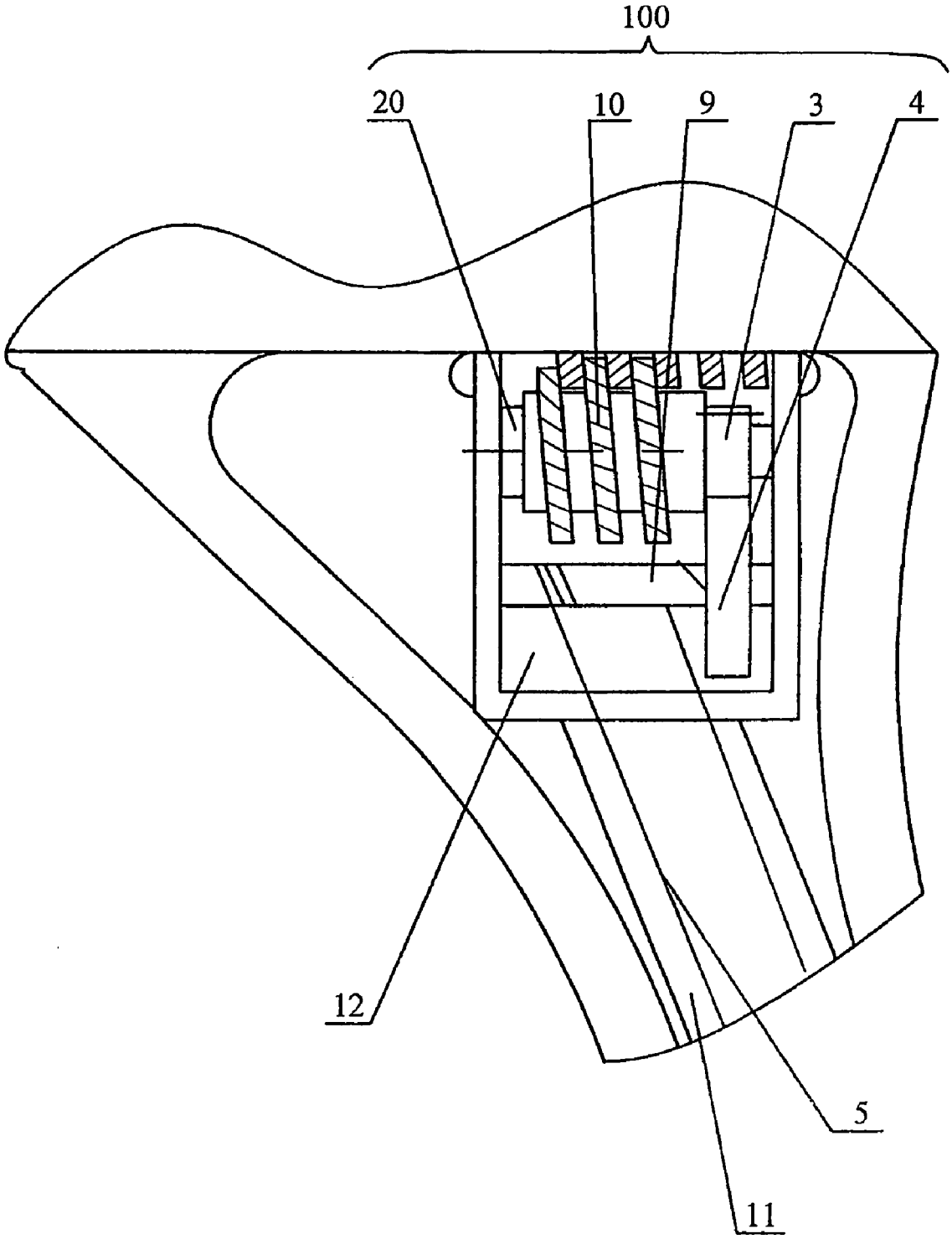
FIG. 2 is an enlarged sectional view of FIG. 1.

In this embodiment of the present invention, a driving mechanism 100 is provided within the chamber 12. As shown in FIGS. 1 and 2, the driving mechanism 100 includes: the worm gear 10, a gear 3, a gear 4 and a connection shaft 9. The worm gear 10 engages the worm 13 of the movable body 2. By rotating the worm gear 10, the worm 13 is driven to move within the chamber 12 in a left-and-right direction, hereby adjusting a distance between the movable body and the stationary body. The worm gear 10 has a worm gear shaft 20. An end of the worm gear shaft 20 is rotatablely connected to a side wall of the chamber 12, while another end of the worm gear shaft 20 is fixedly connected to the gear 3. The connection shaft 9 is disposed under and the worm gear shaft 20 in parallel. The gear 4 is mounted on the connection shaft 9 to engage the gear 3. When the connection shaft 9 is rotated under a force, the gear 4 mounted thereon is further driven to rotate, thereby rotating the gear 3, which in turn renders the worm gear 10 to rotate. In this way, the adjustment of the width of the jaw is reached.

In the embodiment, a traction mechanism 200 connected to the driving mechanism 100 is provided so that a force can be easily applied to the connection shaft 9. As shown in FIG. 1, an elongated cavity 11 communicated with the chamber 12 is formed at a side of a handle 8 of the stationary body 1. The traction mechanism 200 is placed in the chamber 12 and the elongated cavity 11. A guiding wheel 7 is disposed at a side portion of the elongated cavity 11 away from the chamber 12. A driving rope 5 is provided within the elongated cavity 11, which is connected to the driving mechanism 100 through the guiding wheel 7.

Various methods, which permit free rotation of the gear 4 in either a clockwise or a counter clockwise direction, can be used to realize the connection between the driving rope 5 and the driving mechanism 100. To achieve this purpose, in a preferred embodiment, the driving rope 5 is first wound around the connection shaft 9 with an end thereof at a section of the connection shaft 9 close to the gear 4, and then wound around a rotating member with another end. For example, in FIG. 3, the rotating member is the connection shaft 9 itself, and in this case another end of the driving rope 5 is wound around a section of the connection shaft 9 away from the gear 4 in an opposite direction after wrapped around the guiding wheel 7. Preferably, the driving rope 5 is made of high strength and durable materials. The rope can be of a little bit flexibility, so that it can be always tightly disposed between the rotating member and the guiding wheel 7.

Figure 3:
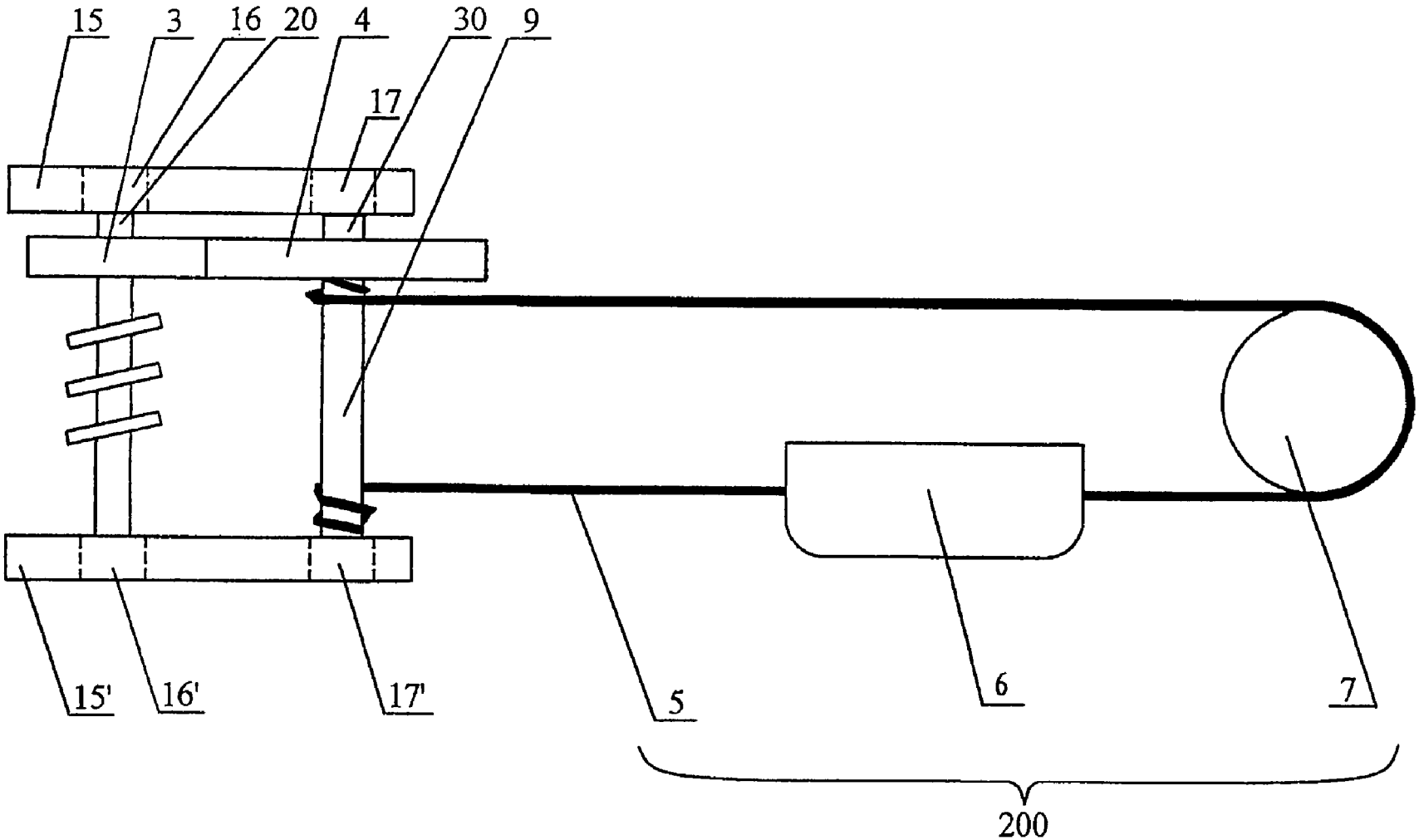
FIG. 3 is a schematic view showing a connection structure of the driving rope in FIG. 2.
Figure 4:
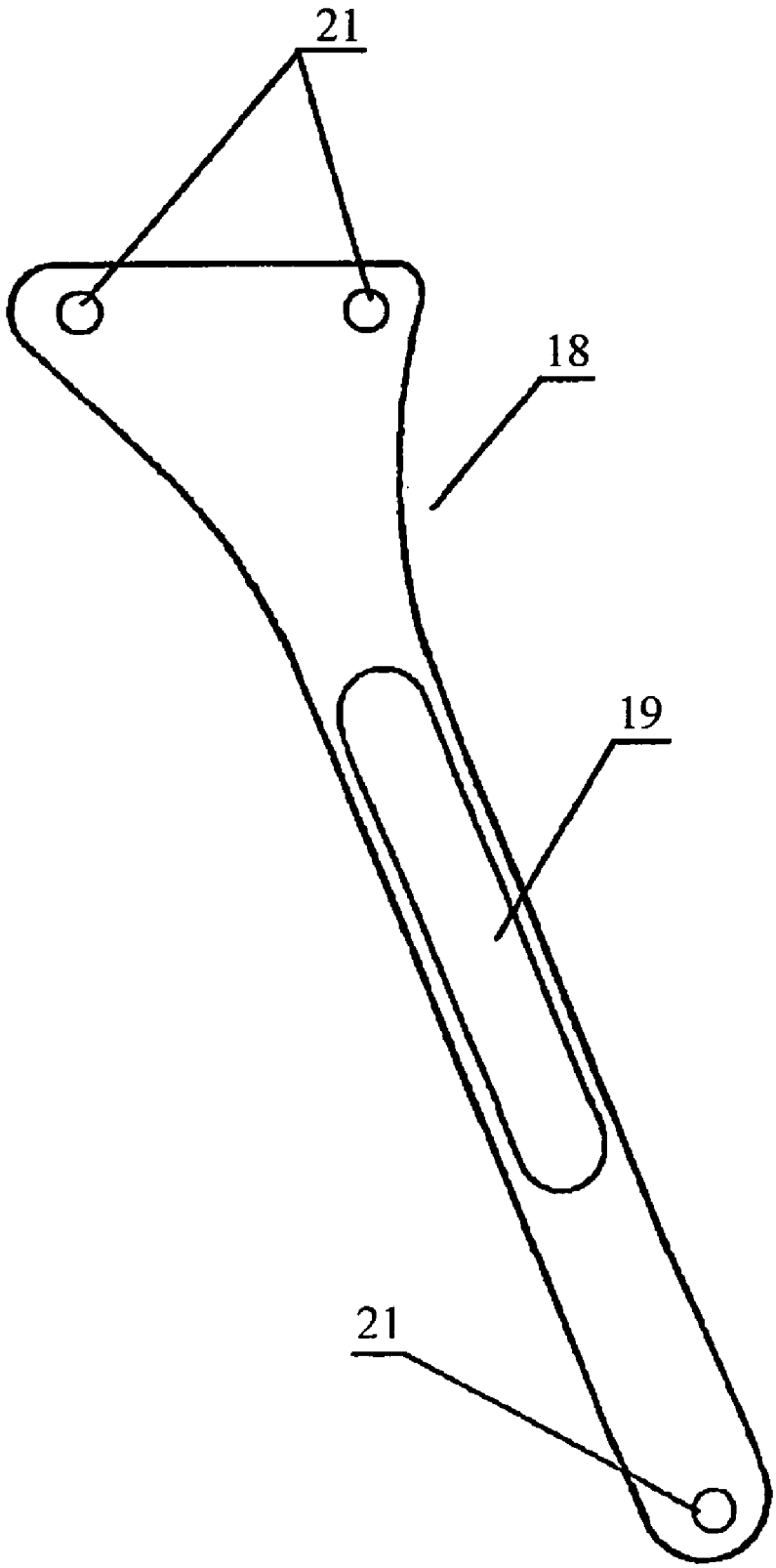
FIG. 4 illustrates the structure of a cover plate according to one embodiment of the present invention.

A control button 6 is disposed at the driving rope 5 so that the driving rope 5 can be controlled by moving the control button 6 in either a forward or a rearward direction. As shown in FIG. 3, the control button 6 can be disposed in a proper position of a side of the driving rope 5 with respect to the guiding wheel 7. For convenient operation, the control button 6 is preferably of a rectangular shape which is slightly smaller in width than the elongated cavity 11, so that the control button 6 can be placed in and moved along the elongated cavity 11. Moreover, a groove 61 is provided along a longitude direction at a side of the control button 6 facing to the elongated cavity 11. A side of the driving rope 5 at which the control button 6 is not positioned is inserted into the groove 61, and is movable along the longitude direction of the groove 61. Thus, the movement of the driving rope 5 can be readily controlled to thereby improve operational reliability of the adjustable wrench.

In operation, the control button 6 is pushed to pull the driving rope 5 so as to rotate the connection shaft 9, which renders the gear 4 to rotate. The gear 3 engaged with the gear 4 is then driven to rotate, which in turn drives the worm gear 10 to rotate. The worm gear 10 drives the worm draft 13 at the lower portion of the movable body 2 to rotate, hereby making the movable body 2 move in a left-and-right direction. The pushing of the control button 6 is stopped until the movable body 2 is adjusted to a proper position, and the self-locking effect between the worm and the worm gear will make the movable body 2 locked. When the movable body 2 is intended to be moved in an opposite direction, the control button 6 should be pushed in an opposite direction, the connection shaft 9 and the worm gear 10 will be rotated in an opposite manner, and thus the moveable body will also be moved in an opposite direction.

According to another preferred embodiment of the present invention, two rigid joint flakes 15 and 15' are provided as shown in FIGS. 1 and 3. Two circular holes 16 and 17 are provided at the joint flake 15 while other two circular holes 16' and 17' are provided at the joint flake 15 in positions corresponding to the circular holes 16 and 17, to form two pairs of circular holes 16 and 16', and 17 and 17'. In such a way, two ends of the worm gear shaft 20 and those of the connection shaft 9 are respectively rotatably inserted into the circular holes 16 and 16', and 17 and 17'. Thus, the worm gear 10 and the driving mechanism 100 can be assembled together, and can be put into and taken off from the chamber 12 of the stationary body 1 as a whole, and thereby is convenient for manufacture and maintenance.

According to another preferred embodiment of the present invention, a cover plate 18 is further provided on the elongated cavity 11 and the chamber 12 of the stationary body 1. As shown in FIG. 1, the cover plate 18 has a shape corresponding to a peripheral shape of the chamber 12 and the elongated cavity 11. An elongated slot 19 is formed at the cover plate 18 for showing up the control button 6 which permits a user to operate by hand. The length of the elongated slot 19 is configured without affecting the movement of the control button 6 within the elongated cavity 11 when adjusting the width of the jaw. The cover plate 18 can be secured at the stationary body through a joint member for covering the chamber and the elongated cavity. For example, screw bores 21 and 22 are provided in a proper position of the cover plate 18 and the stationary body 1, respectively, and thus the cover plate 18 and the stationary body 1 can be coupled together by means of a screw or a bolt or the like. This configuration provides a neat appearance of the wrench, and is suitable to protect all elements within the chamber 12 and the elongated cavity 11.

Moreover, according to a further preferred embodiment of the present invention, a square through hole 14 is provided at the handle 8 of the stationary body 1 to allow insertion of a handle of a socket wrench.

The adjustable wrench of the present invention by setting conventional gears 3 and 4 to provide a linear connection for driving the movement of the jaw, overcomes the deficiencies of the prior art. The wrench of the invention can be manufactured in a low cost, and kept a long life for use. Meanwhile, the driving rope of the present invention makes the wrench more convenient.

The invention claimed is:

1. An adjustable wrench for quickly adjusting the width of a jaw, comprising:

a stationary body having a chamber at an upper portion thereof;

a movable body having a worm at a lower portion thereof, being movable transversely inside the chamber;

a driving mechanism located within the chamber, including:

a worm gear with a worm gear shaft, engaging the worm, a first gear mounted at an end of the worm gear shaft of the worm gear, a connection shaft located under the worm gear shaft in parallel, and a second gear mounted at an end of the connection shaft to engage with the first gear; and a traction mechanism connected to the connection shaft, wherein the traction mechanism drives the second gear to rotate by driving the connection shaft, which drives the first gear to rotate, thereby rendering the worm to move inside the chamber, and wherein the driving mechanism further includes two joint flakes for integrating the worm gear and the driving mechanism and holes provided in corresponding positions of each of the joint flakes, respectively, so that both ends of the worm gear shaft and those of the connection shaft can be rotatably installed in the holes.

2. The adjustable wrench of claim 1, wherein the stationary body includes an elongated cavity positioned at a side of a handle of the stationary body, and the traction mechanism includes a guiding wheel disposed within the elongated cavity away from the chamber and a driving rope connected to the connection shaft via the guiding wheel.

3. The adjustable wrench of claim 2, wherein the driving rope, with an end thereof, is tightly wound around the connection shaft in a direction, and is tightly wound around the connection shaft in an opposite direction with another end thereof, after wrapped around the guiding wheel.

4. The adjustable wrench of claim 3, wherein the driving rope is made of materials with a high strength and slight flexibility.

5. The adjustable wrench of claim 3, wherein a control button is provided at a section of the driving rope.

6. The adjustable wrench of claim 5, wherein the traction mechanism further includes a cover plate for covering the chamber and the elongated cavity, having a shape corresponding to a peripheral shape of the chamber and the elongated cavity, an elongated slot is provided at the cover plate for exposing the control button, and the cover plate is secured at the stationary body by a joint member.

7. The adjustable wrench of claim 6, wherein the joint member includes screw bores disposed at the cover plate and the stationary body, respectively, and screws or bolts matched with the screw bores.

8. The adjustable wrench of claim 1, wherein a through hole is provided at the handle.

* * * * *